US008950823B2

(12) United States Patent
Kristerson et al.

(10) Patent No.: US 8,950,823 B2
(45) Date of Patent: Feb. 10, 2015

(54) METHOD AND DEVICE FOR WORKING ROCK

(75) Inventors: Mats Kristerson, Vollsjö (SE); Carl-Gustav Martinsson, Löberöd (SE); Sverker Hartwig, Täby (SE); Kaj Emanuelsson, Viken (SE); Morgan Norling, Örebro (SE); Gunnar Nord, Sollentuna (SE)

(73) Assignee: Atlas Copco Craelius AB, Märsta (SE)

( * ) Notice: Subject to any disclaimer, the term of this patent is extended or adjusted under 35 U.S.C. 154(b) by 0 days.

(21) Appl. No.: 13/574,739

(22) PCT Filed: Jan. 26, 2011

(86) PCT No.: PCT/SE2011/050080

§ 371 (c)(1),
(2), (4) Date: Jul. 23, 2012

(87) PCT Pub. No.: WO2011/093777

PCT Pub. Date: Aug. 4, 2011

(65) Prior Publication Data

US 2012/0313422 A1 Dec. 13, 2012

Related U.S. Application Data

(60) Provisional application No. 61/298,307, filed on Jan. 26, 2010.

(51) Int. Cl.
*E21D 9/10* (2006.01)
*E21C 27/24* (2006.01)

(52) U.S. Cl.
CPC ..... *E21D 9/1013* (2013.01); *E21D 9/1026* (2013.01); *E21C 27/24* (2013.01)
USPC ..... 299/73; 299/31; 299/72; 299/78

(58) Field of Classification Search
CPC ..... E21D 9/102; E21D 9/1026; E21D 9/1013
USPC ..... 299/31, 71, 72, 73, 78, 85.1
See application file for complete search history.

(56) References Cited

U.S. PATENT DOCUMENTS 3,596,997 A * 8/1971 Valantin ..... 299/72
4,045,088 A 8/1977 Bechem (Continued)

FOREIGN PATENT DOCUMENTS

EP 2000627 A2 * 12/2008
GB 801615 A 9/1958
WO WO-93/07359 A1 4/1933

OTHER PUBLICATIONS

PCT/ISA/210—International Search Report—May 6, 2011.

(Continued)

*Primary Examiner* — David Bagnell
*Assistant Examiner* — Michael Goodwin
(74) *Attorney, Agent, or Firm* — Venable LLP; Eric J. Franklin

(57) ABSTRACT

A method and rig for driving tunnels, galleries, shafts or the like. The rig has a movable base unit that over a support unit supports a carrying unit which in turn carries a cutting head having outwardly directed cutting elements. The method includes rotating the cutting head around a general axis of rotation and applying the cutting head against a rock surface to be worked. The carrying unit is swung into a first chosen mutual position in respect of the support unit. The support unit is rotated into a second chosen mutual position with respect to the base unit around an axis that is essentially longitudinal with respect to the base unit. An angle of operation of the cutting head is controllable.

16 Claims, 6 Drawing Sheets

(56) References Cited

U.S. PATENT DOCUMENTS

| | | | | | |
|---|---|---|---|---|---|
| 4,470,635 | A | * | 9/1984 | Paurat et al. | 299/1.8 |
| 4,548,442 | A | * | 10/1985 | Sugden et al. | 299/10 |
| 4,629,010 | A | | 12/1986 | Sourice | |
| 4,721,340 | A | | 1/1988 | Wrulich et al. | |
| 4,838,614 | A | * | 6/1989 | Pentith et al. | 299/15 |
| 5,192,116 | A | | 3/1993 | Turner et al. | |
| 5,205,612 | A | * | 4/1993 | Sugden et al. | 299/10 |
| 5,308,151 | A | | 5/1994 | Sugden et al. | |

OTHER PUBLICATIONS

PCT/ISA/237—Written Opinion of the International Searching Authority—May 6, 2011.

* cited by examiner

METHOD AND DEVICE FOR WORKING ROCK

CROSS-REFERENCE TO RELATED APPLICATIONS

This application claims priority under 35 U.S.C. §120 to U.S. provisional patent application 61/298,307 filed 26 Jan. 2012 and is the national phase under 35 U.S.C. §371 of PCT/SE2011/050080 filed 26 Jan. 2011.

FIELD OF THE INVENTION

The invention concerns a method and a rig for driving tunnels, galleries or the like.

BACKGROUND OF THE INVENTION

During tunneling as well as mining, the very process of driving tunnels, galleries, shafts or the like is a time consuming, energy consuming and costly element. For completing all these spaces besides the driving, securing roof, floor, walls and possible surface treatment has to be added. During driving of tunnels and galleries, it is previously known to use rigs having cutter wheels, which during working are brought to sweep the rock surface to be worked with the aid of a swinging and pivoting boom and drive arrangement arranged on a carrier vehicle. A rotatable cutter wheel with bar-like working tools is then arranged to carry out rock working.

As a representative of the background art, U.S. Pat. No. 4,721,340, can be mentioned. Other representatives of the background art are U.S. Pat. No. 4,629,010 and WO 93/07359 and GB 801 615.

All these representatives of the background art are suffering from the above mentioned drawbacks, namely, time, energy and cost demanding operation.

AIM AND MOST IMPORTANT FEATURES OF THE INVENTION

An aim of the present invention is to provide a method and a rig as indicated above wherein the drawback of the background art are addressed and at least reduced. This is achieved through the features of the respective independent claims.

The invention concerns working rock by means of a cutting head rotating around a general axis of rotation with the rock cutting element being directed essentially radially outwardly, wherein is intended that the rock cutting elements are positioned distributed around the area of the envelope surface of the cutting head. Further it is intended that the cutting head is applied against a rock surface to be worked by this area of the envelope surface being brought to engagement with the rock.

When it concerns the inventive method for driving tunnels, galleries or the like, a method according to the above for driving tunnels, galleries or the like with a driving rig having a movable base unit which over a support unit supports a carrying unit which in turn carries a cutting head having outwardly directed cutting elements, includes:

rotating the cutting head around a general axis of rotation and applying the cutting head against a rock surface to be worked, transporting cut loose material away from said rock surface, swinging the carrying unit into a first chosen mutual position in respect of the support unit, rotating the support unit into a second chosen mutual position in respect of the base unit around an axis which is a longitudinal axis of the base unit, whereby an angle of operation of the cutting head is controllable, and performing tunnel side cuts essentially in parallel with said longitudinal axis with the rotated cutting head advancing with the angle of operation being a skewed angle.

Through "axis which is a longitudinal axis of the base unit" is intended an axis which extends essentially in a longitudinal direction of the base unit. This axis could be or be parallel with a symmetry axis of the base unit or a part of the base unit and/or be an axis which is parallel with an essential movement direction of the rig. It is to be noted that swinging the carrying unit into a first chosen mutual position in respect of the support unit, can mean that the carrying unit is held centrally during operation or be swung outwards, depending i.a. of the width of the intended tunnel (or the like).

Through "a chosen mutual position" is intended a desired position, which is the result of relative movement between two movable units.

According to the present description, a single stroke (on a part of the total tunnel/gallery face) performed according to the inventive method and by the rig is referred to as a "cut". "Cuts" means a plurality thereof. "Central cut" is a cut performed in the centre of the tunnel/gallery which is essentially central as seen in a vertical symmetry plane of the tunnel/gallery. Cuts not being "central cuts" are referred to as "side cuts". "Side cuts" are normally cuts performed most sideward, but it is not excluded that more than one "side cut" with differently skewed cutting head is performed at one or each side of said vertical symmetry plane.

With "an angle of operation of the cutting head" is here meant an angle between a general plane of the cutting head, said plane being perpendicular to the general axis of rotation of the cutting head, and a vertical longitudinal symmetry plane of the driving rig, in a normally positioned straight forward directed cutting head. (Or more generally speaking, in respect to a vertical line). This general plane of the cutting head will, through rotating of the support unit be "tilted" so as to obtain the skewed angle whereby cutting can be tailored for forming desired shapes of tunnel roofs. It should be noted that the "angle of operation of the cutting head" is set by rotating the support unit into in respect of the base unit around said axis being a longitudinal axis of the base unit.

"Horizontally" and "vertically" herein is to be seen in respect of the rig. They can obviously deviate from true horizontal and vertical directions, lines, planes etc.

Through the invention, advantageously is achieved that it is possible in a very simple and fast way to form tunnel (and the like) roofs that are vaulted in a desired shape, whereby the stability of the roof is increased and rock face stabilisation can be installed more adequately compared to tunnels having plane roofs or stepped profile roofs.

With the feature: performing tunnel side cuts with the rotated cutting head advancing with a skewed angle, is to be understood that side cuts are made with the cutting head somewhat tilted and thus having a skewed angle of operation being, for example about 30 degrees at both sides, when three cuts are made. Normally the side cuts are performed in an uplifted state of the rig so as to produce a roof level of the tunnel/gallery being higher than the diameter of the cutting head. Hereby firstly, fewer cuts have to be made to obtain an acceptable roof profile. Secondly the tunnel roof will attain a profile that is "vaulted" in that the roof profile will be comprised of adjoining rock face portions with successively altering angles as seen in a section of the tunnel/gallery.

An example: A roof produced through a number of cuts (exemplary three) with a cutting head revolved as great an angle that is necessary for the creation of said adjoining rock face portions being said skewed angle (exemplary 30 degrees) between a central cut with vertically positioned cutting head and the respective side cuts will have face portions corresponding to the peripheral section of the cutting head, said faces extending along the length direction of the tunnel and forming corresponding skewed angle (exemplary 30 degrees) to each other. It is of course possible to produce roofs with more than three cuts, such as five, with one central cut and two successive side cuts with differently skewed angle on either side. This can be particularly interesting in respect of more narrow cutting heads. Roofs can also be produced through an even number of cuts, wherein all are made with the cutter head skewed at different angles so as produce face portions adjoining with mutually correspondingly skewed section portions. In that case, all roof cuts are "side cuts".

Also tunnels made according to the invention have to be secured through installation of rock bolts, but the expected load will be advantageously reduced compared to background art plane roofs and installation will be easier. Vaulted roofs made according to other, conventional methods, would be more time consuming and thereby less economic to produce.

Further, a method according to the invention results in considerably faster tunneling in that, typically, for obtaining a tunnel having a vaulted roof or at least vault-like profile roof, fewer driving steps have to be taken for achieving similar (and even better) result.

Preferably the rock cutting elements are formed as at least peripherally disc shaped cutting rolls that are brought to roll against the rock side during pressing against the rock and rotation of the cutting head. The rock cutting elements are during rolling brought to cut sidewardly arranged grooves in the rock surface at a distance from each other.

Preferably the cutting head is pressed against the rock by being displaced linearly in a driving direction against rock to be worked in a drifting phase.

After a completed driving phase, the cutting head is drawn away from the rock, displaced to a position with new rock to be worked and repeatedly is brought linearly against the rock for a new driving phase.

Advantageously the rotating cutting head is pressed in a direction which forms an angle between about 70° and 90° against the general axis of rotation against the rock surface to be worked.

Advantageously, also, rotation of the support unit in respect of the base unit is made between 0° and 90° from a neutral position where the general axis of rotation (R) is essentially horizontal for best possible adaptation to desired operation.

An arch-profiled roof of a tunnel or a gallery is advantageously shaped by applying and driving the cutting head with the support unit rotated into different angles in respect of the base unit for each one of a number of cuts.

Preferably, one uppermost, centre cut is made with the support unit not rotated and two, for producing cuts at the respective upper sides of the arch-profiled roof, with the support unit respectively rotated so as to obtain said skewed angle of the cutting head.

In order to obtain a preferred tunnel/gallery height, a tunnel or gallery can be shaped by driving bottom driving phases with the support unit not rotated in respect of the base unit and with each one of said bottom cuts with carrying unit swung into different mutual positions in respect of the support unit, and wherein said arch-profiled roof is produced through elevated driving phases with the rig in said uplifted state.

Typically a face of a profiled roof of a tunnel, gallery or the like is shaped as a section of an envelope surface of the cutting head.

A rig for driving tunnels, galleries or the like according to the invention for driving tunnels, galleries or the like includes a base unit, which includes:

stabilizing units for stabilizing engagement with at least one of a floor, a first side wall, a second side wall and/or a roof, a pressing unit for pressing a rotational cutting head having outwardly directed cutting elements against rock to be worked, drive means for rotational driving of said cutting head, wherein the rig has means for transporting away material being loosened during cutting, a movable base unit which over a support unit supports a carrying unit which in turn carries the cutting head.

The rig further includes:

a swinging arrangement for swinging the carrying unit into chosen mutual positions in respect of the support unit, a rotation arrangement for rotating the support unit into chosen mutual position in respect of the base unit around an axis which is a longitudinal axis of the base unit, whereby an angle of operation of the cutting head is controllable, and means for positioning the rotated cutting head in a skewed angle during advancing thereof essentially in parallel with said longitudinal axis for performing tunnel side cuts with the cutting head advancing with said skewed angle.

Preferably the carrying unit with the cutting head is swingable through a side swinging arrangement such that when the cutting head is pressed against the rock face to be worked, the general axis of rotation will form angles between about 70° and 90° with the pressing direction.

The support unit has preferably at opposite edges opposite circular arc-shaped guide grooves for displaceable reception of guide elements of the carrying unit.

Preferably, stabilizing units acting vertically against a floor or a roof are arranged for lifting the base unit from the first working position for operation on a lower level, to a second operational position for operation on a higher level.

Preferably, the arrangement is such that the rotating cutting head in operation is pressed in a direction which forms an angle between about 70° and 90° against the general axis of rotation against the rock surface to be worked.

By using rock cutting elements, which are formed as at least peripherally disc shaped cutting rolls are brought to roll against the rock side during pressing against the rock and rotation of the cutting head, and wherein the rock cutting elements during rolling are brought to cut sidewardly arranged grooves in the rock surface at a distance from each other, the amount of rock that has to be disintegrated through direct working through the very rock cutting elements is minimized through the fact that only grooves in the rock side have to be cut through rolling contact with the rock, wherein the grooves lie at a distance from each other, and this in an advantageous and effective way through the features of the cutting head.

Material between the grooves will pre-dominantly be split off by itself, because of self induced cracking in the material during groove cutting. Possibly only partly loosened material can thereupon simply be loosened from the worked rock side, for example during next application of the rotational cutting head. Hereby is obtained that the energy consumed for fine disintegrating rock material can be minimized so that time, energy and cost can be reduced.

Further, the very elements working the rock can be used considerably longer as seen per amount of worked rock than in previous, corresponding methods according to the background technology because of the reduction of wear on these elements. Groove width, groove depth and distance between grooves are chosen after application and after the properties of the rock, in particular its susceptibility to form cracks. These parameters can be determined during field tests, practical analysis and/or through laboratory tests and calculations. During dimensioning, of course also the resistance of the rock cutting elements and chosen material for these are of greatest importance, since the thickness of the rock cutting elements is directly determining of the width of the formed grooves. The material in a cutting roll is otherwise per se known high resistance material used previously for similar applications. A cutting roll can also be equipped with hard metal inlays distributed around the circumference.

The fact that only rock material in the area of the grooves intended for being formed will have to be disintegrated is achieved in that the rock cutting elements are formed as at least partially disc shaped cutting rolls, which are brought to roll against the rock side during pressing against the rock and rotation of a cutting head, and that they during rolling are brought to cut sideways arranged grooves that lie at a distance from each other. Hereby is intended that the cutting rolls are essentially disc shaped or partially peripherally essentially disc shaped, wherein it is intended that they should be flat, essentially circular with generally the same thickness, at least peripherally. Hereby it is achieved that grooves are formed which have essentially the same width over the depth of the grooves in the rock side, whereby material between the grooves thereby do not have to be disintegrated, which brings about the above mentioned advantages both as concerns energy consumption and as concerns wear on the rock cutting rock working elements.

The invention, however, also includes having differently shaped rock working elements such as non-rotational, stud-like, bar-like, button-like etc elements even if disk-shaped or part disk-shaped elements according to the above are preferred.

When the cutting head is pressed linearly against the rock to be worked, and on demand, after a completed working phase, the cutting head is drawn away from the rock, moved to a new place with new rock to be worked whereupon the method is repeated in a subsequent working phase.

Normally for vertical shafts and certain tunnel driving and the like, the rotating cutting head is pressed in a direction essentially at a right angle to the general axis for rotation against a rock surface to be worked.

For a certain type of tunnel driving it is, however, very advantageous in a sideways swung-out position of a cutting head axis in a direction which forms an angle of between 70° and 90° to a general axis or rotation against a rock surface to be worked. This can be of interest for example during gallery or tunnel driving when a rig is being used which provides pressing of the cutting head in a direction corresponding to the gallery or tunnel direction also with the cutting head being angled outwardly. Because of the geometry hereby, also in most swung-out position, usually 12°-15° and up to about 20°, when using cutting rolls, a path of a cutting roll is to deviate so little from a groove formed by previous rolls in a group that the above discussed and desired effect will occur anyway. Values somewhat above 20° are not excluded in this connection.

At occasions, partly stuck material between the cut grooves are loosened through mechanical actuation, for example with scrapes and buckets positioned on or at the cutting head in the area of the cutting roads. All together, loosened material is thereupon brought away in a per se known manner through for example elevators, conveyer belts or in any other suitable manner.

In particular it is preferred that a force applied for pressing the cutting head against the rock is controlled as a function of applied torque for rotation of the cutting head or alternatively applied effect for rotation of the cutting head. Hereby is ensured that the driving efficiency is held at a height level. Particularly preferred for this purposes is that applied torque for rotation of the cutting head or applied effect for rotation of the cutting head is controlled in the direction of maximizing. Hereby wear, working life, power consumption etc. should be considered.

When using cutting rolls, the roll rotation shafts for at least a part of the cutting rolls are suitably parallel with the general axis of rotation, but it can occur, in particular for cutting rolls positioned more at the sides of the cutting head, that the roll rotation shafts form an angle with the general axis of rotation. In particular the cutting rolls on the cutting head preferably form a profile which deviates from a cylinder and such that the cutting head generally can be seen with a rounded profile, for example as a part of sphere. The cutting rolls at the outer sides of the cutting head are suitably angled somewhat more at the sides so that there active cutting surfaces reach axially outside fastening ears, cutting head sides etc for facilitating contact with unworked rock sidewardly and avoid that the cutting head gets stuck. As an example, the angle between the roll shafts and the general axis of rotation can amount to above 45°. The angle is, however, usually considerably below this value. In these areas the rolls can be arranged in rows or groups with smaller distance than what is stated above, for example about 20 mm.

It is to be understood that in general the cutting head is shaped as a body with plane sides or at least with sides without any cutting rolls, since the greatest working effect is achieved through essentially linearly disposed cutting rolls having their shafts being parallel to the general axis of rotation. However, rounded cutting heads can be suitable when it comes to tunneling or gallery driving, wherein the shape or the cutting head can be such that an even circular cavity section results from diving according to the invention.

The rock cutting elements are preferably comprised of rolls in the form of discs having essentially circular circumference or rolls with radially protruding and peripheral disc portions with essentially circular circumference.

A rig according to the invention for driving tunnels, galleries or the like includes a base unit having: stabilizing units or stabilizing engagement with a floor, a first side wall, a second side wall, a roof; a pressing unit for at least one rotatable cutting head against rock to be worked; and drive means for rotational driving of said cutting head, wherein the rig provides means for transporting away material being loosened through cutting. Further it includes a carrying unit for carrying, rotation and displacing the cutting head.

Most preferred the rig includes a cutting head quipped with cutting elements in the form of cutting rolls as described above whereby said pressing unit is arranged for pressing in a pressing direction of said cutting head against the rock during rotation of the cutting head such that the rock cutting elements that are arranged on said cutting head are brought to roll against the rock side during forming of sidewardly positioned grooves that are lying at a distance from each other in the rock side.

Preferably the base unit is a mobile vehicle with wheels, crawler bands or a stepping advancing system allowing movement of the rig. It is, however, not excluded that the rig can be moved by external propulsion means. The pressing unit is typically operative in a general movement direction of the base unit.

Stabilizing units acting vertically against a floor and a roof respectively are suitably arranged for lifting the base unit from a first working position for working on a lower level to a second, uplifted working position for operation on a higher level so as to produce the tunnel (etc) roof.

The base unit preferably is provided with a rear extending/shortening telescopic unit besides the pressing unit and arranged behind this, as seen in the pressing direction; said telescopic unit allows extra elongation/shortening of the total length of the base unit.

Basically the method and the rig according to the invention is about producing tunnels or galleries that are intended for driving of vehicles, i.e. tunnels or galleries that are at least essentially horizontal or at least have such directions relative to the horizontal direction that they are fit for driving in with vehicles. The directions of the produced tunnels or galleries thus have horizontal components exceeding its vertical components. Normally, the slope of a produced tunnel or gallery is considerably below 1:5 (20%) between vertical direction component and tunnel/gallery length. The obtained tunnels or galleries are therefore subject to forces in the rock that makes it advantageous to have vaulted roofs.

In order to make it possible to drive tunnels, galleries or the like according to the invention, a rig that is used for the purpose needs sufficient stability and precision in order for the cutting head not to wobble forth and back during the operation. This is achieved on the one hand by the very rig itself being sufficient rigidity, on the other hand that it has operative stabilizing units according to the above so that the rig can be fixed in a stable manner in respect of the rock to be worked. Hereby is achieved by the one hand that a sufficiently great pressure force can be applied to the cutting head during the drift, on the other hand that the cutting can be preformed with sufficient precession since it is avoided that the rig moves in a non desired manner during the drift.

Further features and advantages of the invention are objects of further claims and will come clear from the below detailed description of embodiments.

BRIEF DESCRIPTION OF DRAWINGS

The invention will now be described in greater detail by way of embodiments and with reference to the annexed drawings, wherein:

FIG. 4*a* shows diagrammatically a section through a tunnel or a gallery produced by the inventive rig whereas

DESCRIPTION OF EMBODIMENTS

Figure 1A:
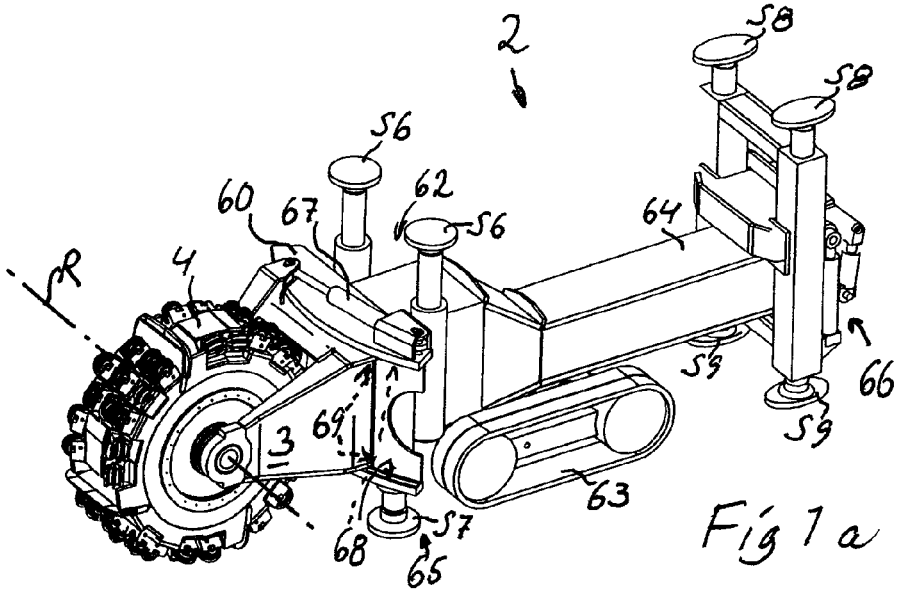
FIGS. 1*a-f* show a rig according to an embodiment of this invention in different positions and different views.

Like and similar elements have partly been provided with the same reference numbers.

The working rig according to the invention is intended for driving essentially horizontal tunnels and galleries as is discussed above.

The rig in FIG. 1*a-f* has a base unit 2 with crawler bands 63 for moving forward and (not shown) driving motor, transmission, drive means for the working equipment and control means.

The base unit has on a front side a carrying unit 3 for a cutting head 4. The cutting head 4 is supported on the free end of the carrying unit 3 and is with a main body extended and rotatable around a general axis or rotation R in the area of an end part of the carrying unit 3. A (not shown) rotation motor with a transmission for the cooperation with a drive shaft of the cutting head 4 is positioned inside of the cutting head 4.

Radially and peripherally on the cutting head 4 are arranged, distributed over the perimeter and width, a number of cutting rolls 7 or rock cutting elements having circular, disc shaped periphery, which will be described in more detail below. At rotation of the cutting head 4 and simultaneous pressing of the cutting head 4 against a rock side to be worked, hereby there are grooves cut in the rock, grooves that are arranged sideward of each other and at a distance from each other. The rock cutting elements are thus arranged at an axial distance from each other, which distance is determined from i.a. the properties of the rock such as hardness of the rock, the ability of the rock to form cracks etc.

For stabilizing the base unit 2 during drifting operation it is provided with an arrangement with stabilizing units S acting against the roof and the floor of the tunnel of the gallery. It is also possible to provide stabilizing units that act against the side walls. The shown units are jack-like support units that connected to the base unit.

The rolls 7 have at least radially most outwardly disc-shaped configuration for cutting of grooves at a mutual distance according to the above.

The cutting rolls 7 can be positioned such that the cutting head 4 receives a rounded form as seen in a direction at a right angle to the general axis of rotation R, against the sides of the cutting head, with the cutting rolls 7 in the central area of the cutting head being carried by roll shafts such that their roll rotation axes are parallel to the general axis of rotation R whereas the sideward positioned cutting rolls are supported by shafts such that the roll rotational axes of these cutting rolls form an angle to the general axis of rotation R. The rolls 7 are carried by fastening ears, which have recesses for said roll shafts.

As an alternative, each cutting roll 7 can include a plurality of rock cutting elements being arranged sideward and at a distance from each other and forming disc shaped portions.

A pressing cylinder being part of a pressing unit (not shown) is intended to press the cutting head 4 against the rock side to be worked with the cutting head 4.

The rig works essentially horizontally for driving tunnels, galleries or the like. The rig is equipped with a forward driving arrangement for the cutting head being arranged to act in a length direction in parallel to a longitudinal axis of the base unit 2 through one or more sufficiently powerful dimensioned hydraulic cylinders or in any other way, for example by way of a link system multiplying force.

The base unit 2 has a forward supporting unit 60, which has a front with a partly circular cylindrical portion for allowing angular displacement and side displacement of the cutting head 4 over the carrying unit 3. The carrying unit 3 is supported by the supporting unit 60 over a combination of part circular guide grooves 68 on the upper and lower part of the support unit 60, said guide grooves 68 being directed towards each other. The carrying unit 3 has (not shown) guide elements indicated with interrupted arrows at 69. These guide elements 69 which can be comprised of for example rolls or pins or blocks, engage in and slide or roll in said guide grooves 68 in order to guide the carrying unit 3 along a partly circular path when actuating a turning device 67. The turning device 67 which in the Figures is in the form of a hydraulic cylinder, is at its one end fastened to an edge of the supporting unit 60 and at its other end at an engagement ear fastened to the carrying unit 3.

The base unit 2 has a forward base portion 62 wherein is integrated a pressing unit for displacement of the supporting unit with supported cutting head 4 in a length direction of the base unit 2. The base unit 2 further has a rear base portion 64 which is lockable-displaceable in a rear stabilizing arrangement 66, which in turn has stabilizing units S8 and S9 for engagement with roof and floor in a tunnel, gallery or the like. Further, a forward stabilizing arrangement 65 has stabilizing units S6 and S7, likewise or engagement with roof and floor in tunnel, gallery or the like. The rig in these Figures is mobile and has a propulsive arrangement which by inactivated stabilizing units S6-S9 can move the rig in a length direction.

Figure 1B:
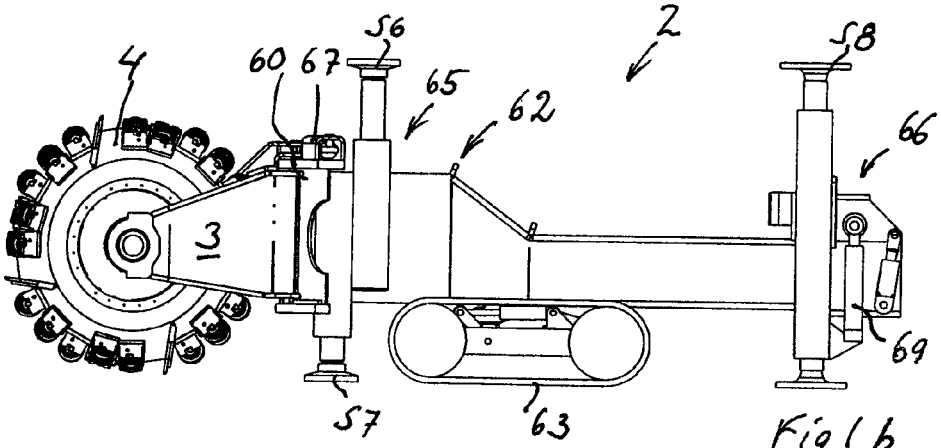
Figure 1C:
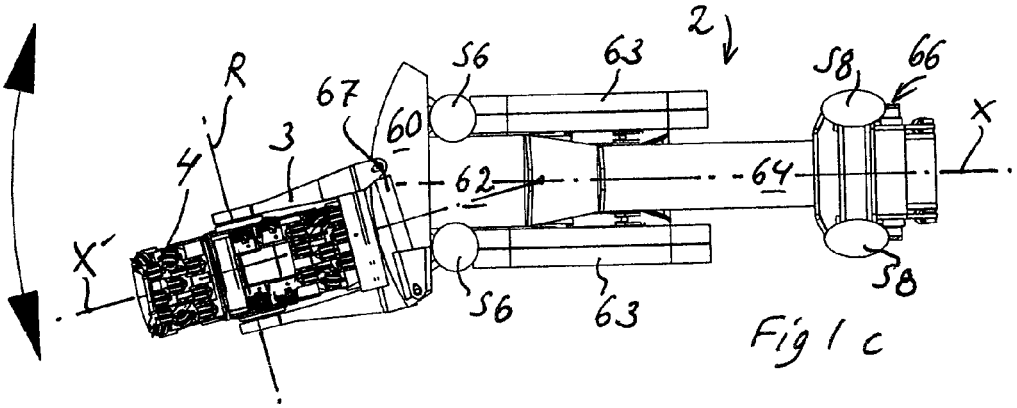

FIG. 1*c* shows the rig in a view from above, whereof clearly is shown that the carrying unit 3 with supported cutting head 4 is angled from a central position to a side position. Activating a forward driving device this way means that the cutting head 4 in swung-out positions will be moved forward somewhat obliquely in respect of its general axis of rotation, wherein the cutting rolls in one and the same group will follow roll paths that somewhat deviate from a path taken by a roll that has already performed a groove depression in the rock material. The deviation will, however, be small because of the geometry and because of that it is suggested a smaller outward swinging of the cutting head during such drifting, usually close to 15° deviation of a "longitudinal axis" X' in respect of the length direction along longitudinal axis X of the machine and from the general extension of the tunnel or gallery, but also with up to about 20° outward swing. This corresponds to applying the cutting head with an angle of between 90° and up to 70° angle to the general axis of rotation R of the cutting head 4.

Figure 1D:
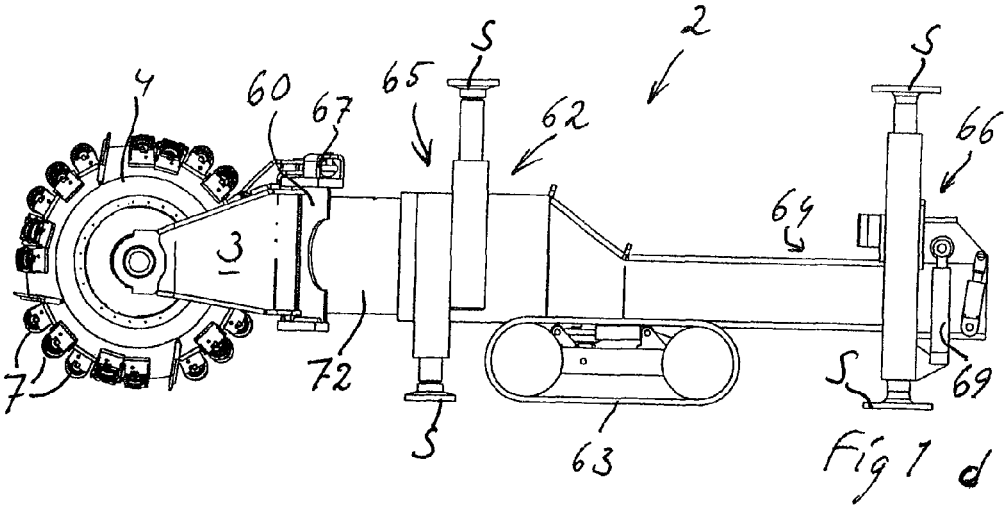

In FIG. 1*d* is shown the rig in FIGS. 1*a-c* in a second position, wherein the pressing unit being included in the forward base portion 62 has pressed the support unit 60 with supported cutting head 4 in a forward direction so far that an inner telescopic portion 72 of said pressing unit is shown. As drive means for a pressing unit can be used powerful hydraulic cylinders, a multiplying link system or the like which can be contained inside the base unit 2.

In the position shown in FIG. 1*d* is in principle shown the pressing unit 62 with the support unit 60 with supported cutting head 4 in a maximally forward driven position. It is of course understood that working is made successively under successive forwarding of the cutting head 4 during its rotation in a continuous manner.

The rear base portion 64 can be reversed through the rear stabilizing arrangement 66 such that an end part thereof, 64' extends beyond this rear stabilizing arrangement 66 as seen in a working direction. This position allows radically backwardly displaced cutting head from a drive place, which can be advantageous for example when space is needed in front of the rig for different types of work to be performed in this position.

In order to make it possible to work on the entire height of a tunnel, the base unit 2 can be raised in respect of the floor in such a way that the lower stabilizing units S7 are pressed outwards and the upper stabilizing units S6 are allowed to be pressed in corresponding to this measure and that the lifting cylinder 69 in the rear stabilizing arrangement 66 is activated for pressing upwards of the rear base portions 64 of the base unit 2 in the corresponding degree. Hereby the cutting head 4 can be lifted to a height corresponding to a desired roof level, whereupon drifting continues in a way that will be explained below.

Figure 1E:
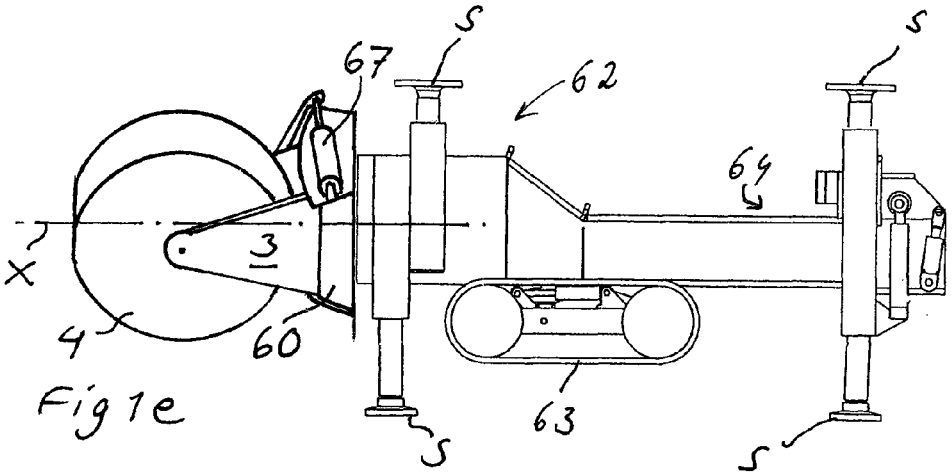

In FIG. 1*e* is shown that the support unit is rotatable about an axis X which extends in the length direction of the base unit 2. Hereby the support unit 60, carrying unit 3 and cutting head 4 can be rotated in respect of the base unit in order to revolve the cutting head so that it is tilted and is positioned in a skewed angle whereupon it is locked in that rotational position and the next cutting sequence starts in order to perform a cut.

Figure 1F:
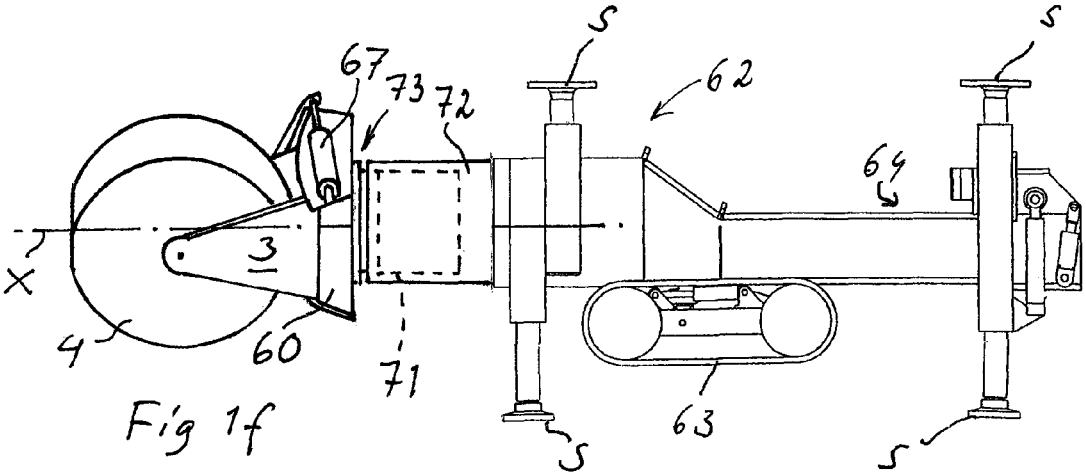

In FIG. 1*f* is shown the rig in a position, wherein the pressing unit being included in the forward base portion 62 has pressed the support unit 60 with supported cutting head 4 in a forward direction so far that an inner telescopic portion 72 of said pressing unit is shown. A rotator is indicated inside the telescopic, axially movable portion 72 with interrupted lines with reference number 71 and is fastened to that portion. With the aid of a rotatable means (not shown) the rotator 71 is capable of rotating the support unit 60 around the axis X. A partition interface between the mutually rotatable parts is referenced with 73. When a chosen rotational position of the support unit 60 has been reached, the parts are rotation locked to each other through mutually locking parts that can be engaged with each other.

In FIGS. 1 *e* and *f*, the support unit 60 is shown rotated about 30° in respect of the base unit through the rotator 71 acting between the support unit and the base unit, which in this case is quadrangular in section. According to this aspect of the invention, the rotator is positioned inside the front part of the base unit and have mutually rotatable and lockable parts that are permanently in engagement with the respective one of the support unit and the telescopic portion 72 and thereby with the base unit.

Figure 2F:
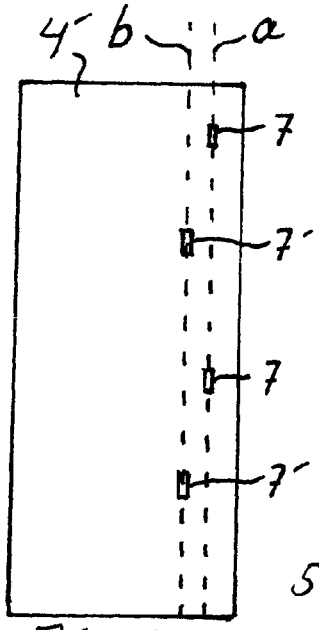
FIG. 2*f* shows diagrammatically the envelope surface of a cutting head in a laid out view, FIGS. 3*a* and *b* show different views of a rig according to a further embodiment of the invention in a position where the rig is elevated and the support unit is rotated about 30°.
Figure 2:
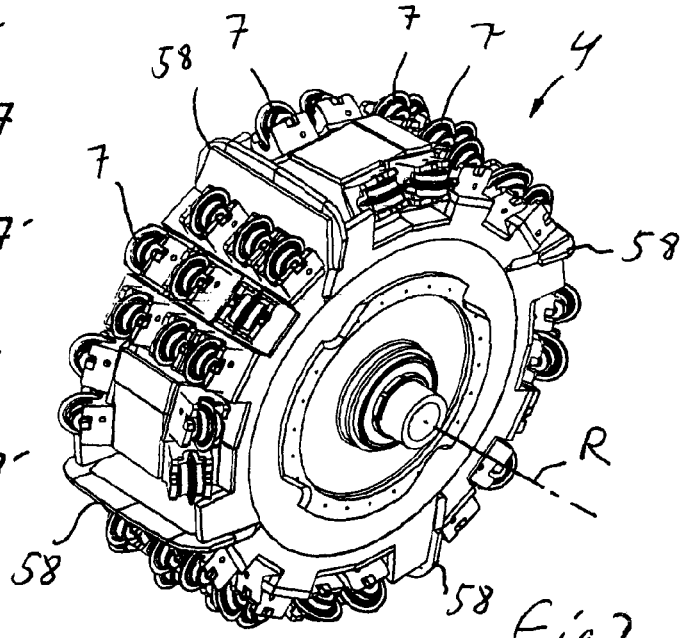
FIG. 2 shows a cutting head in a perspective view.

In FIG. 2 is shown a cutting head 4, which has a great number of cutting rolls 7 distributed in the circumferential direction and in axial direction of the cutting head 4. In this case there are cutting rolls 7 with axes parallel to the general axis of rotation R for the cutting head 4 as well as a number of cutting rolls 7, the rotational axes of which forming an angle with the general axis of rotation R. Further, the cutting head 4 has four material scrapers 58 distributed around its periphery for assisting in loosening partly stuck rock material. The material scrapers 58 are suitably manufactured from a conventional material which is used for corresponding use in connection with scraper machines etc.

Figure 2C:
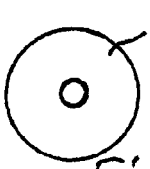
FIGS. 2*a-e* show diagrammatically views of alternative cutting rolls.
Figure 2B:
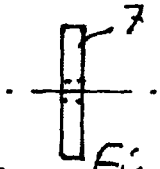
Figure 2A:
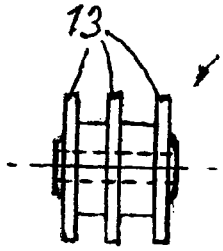

In FIG. 2*a* is shown a variant wherein a cutting roll 7 is constructed with combined sidewards arranged rock cutting elements 13 in the form of radially extending disc portions having essentially circular circumference. This can be true for at least a part of rock cutting elements 13 on a cutting head and the number of rock cutting elements 13 on a cutting roll can vary.

Figure 2E:
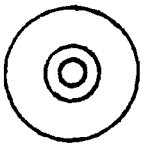
Figure 2D:
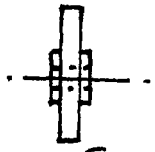

In FIGS. 2*b* and 2*c* is shown a usual variant of a cutting roll 7 which is shaped as a plane circular cylindrical disc with a central through hole for a roll shaft (not shown). FIGS. 2*d* and 2*e* show a further variant of a cutting roll 7, wherein the cutting roll has a peripheral disc shaped portion and centrally, a hub portion extending on either side of the disc shape and with a hole for a roll shaft.

In FIG. 2*f* there is diagrammatically shown an imaginary laid out envelope surface 4' in two dimensions of a cutting head (such as 4 in FIG. 2) in a diagrammatic part representation. The height in the Figure corresponds thus to the peripheral circumference of the cutting head and the width in FIG. 2*f* the axial width of the cutting head. With the dotted lines a and b respectively are indicated two of a plurality (all not shown) different axial levels of a cutting head 4 shown on the laid out envelope surface 4'. Hereby is shown that on one on the same axial level, two cutting rolls are active and thus on the axial level a, two cutting rolls 7 are active and on the axial level b, two cutting rolls 7' are active. This means that during operation of rig with a cutting head 4, two cutting rolls will act for forming one and the same groove, which increases the working speed of the device. It is also possible to have more than two cutting rolls acting in the same groove.

The cutting heads can be shaped otherwise in respect of what is shown in the Figures. Thus, the cutting heads can be constructed thinner or broader compared to its diameter than what is shown.

The rock cutting elements can be of other types and be arranged otherwise even if rolling cutters are preferred. When rolling cutters are used, they can be arranged with holders or separate rock cutting elements such that axially at the same level lying elements form a group or with several rock cutting elements on one respective cutting roll, such that each cutting roll includes rock cutting elements within plural groups, wherein with a group is intended rock cutting elements acting in and for making one and the same groove, see FIG. 2*a*.

Driving of the cutting head can be obtained in a per se known manner, for example through hydraulic means such that a hydraulic driving device is positioned in the carrying unit.

The dimension of the rock cutting elements is suitably such at their width in a radially outermost portion intended to penetrate into the rock is as an example about 8-25 mm and their diameter can be about 200-500 mm. Depending on the hardness of the rock and the used pressing power, the rolls normally penetrates from about 3 to about 12 mm. The rolls are arranged such that the produced grooves are formed with a separation of 50-120 mm, which, as is stated above, depends on the rigidity of the rock, its susceptibility or forming cracks etc.

Cutting heads according to the invention can have very great dimensions with diameters up to and even exceeding 4 meters. Cutting head width can then be, as an example, about or even considerably above 1 meter. The driving effect of the cutting head in such a case needs to be up to, as an example, 1400 kW for hard rock with a rotational speed of from a few rotations per minute through about 20 rpm. As further not limiting example, the telescopic power can amount to 200 tons.

Material being loosened because of cutting of the grooves is transported away suitably through per se known arrangements associated with the rig, suitably through an opening axially through the rig.

Figure 3A:
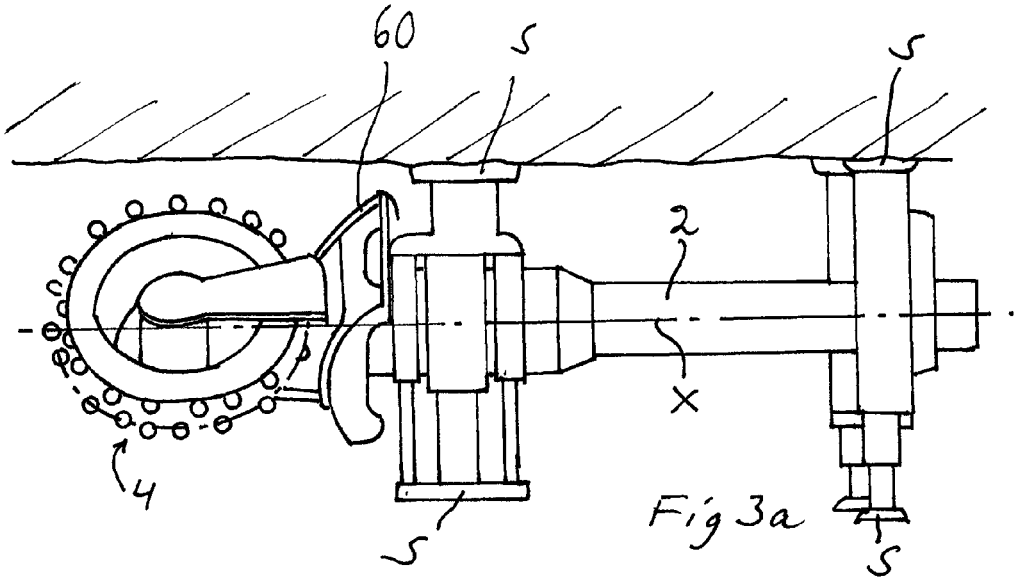
Figure 3B:
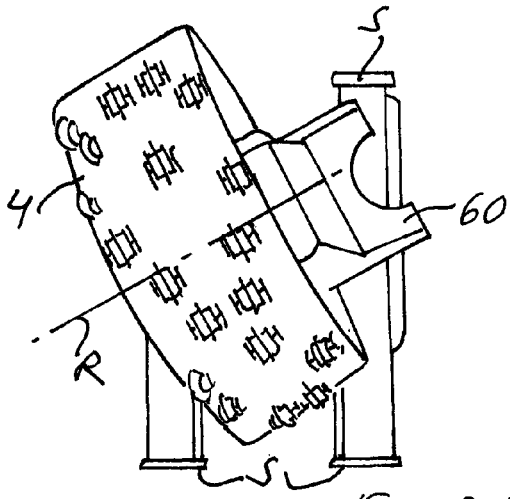

FIGS. 3*a* and *b* show in different views a rig according to another embodiment in a position where the support unit 60 is elevated and also is rotated about 30° in respect of the base unit 2 around an axis X which is a longitudinal axis of the base unit. The carrying unit 3 is here essentially central on the support unit 60. In FIG. 3*b* the cutting head 4 is shown slightly obliquely from the front of the rig. S indicates stabilizing units.

Figure 4A:
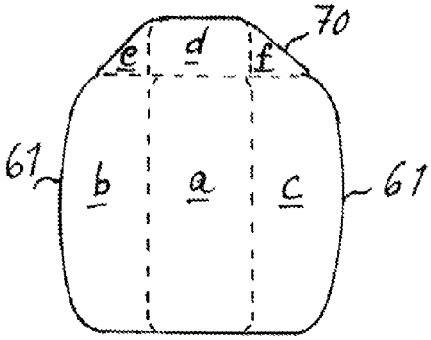

FIG. 4*a* shows diagrammatically a section through a tunnel or a gallery produced by the rig in FIGS. 3*a* and *b*, 70 indicates the vaulted roof having been produced through three bottom (a, b and c) and three top cuts, whereof one centre (d) (uppermost) with cutting head held straight and two (e and f) (upper side cuts) with rotated (revolved) cutting head. 61 are the tunnel side walls. As can be seen from this figure, the upper cuts (d, e and f) are made in respect of only small parts of the possible cut height of the cutting head.

Figure 4B:
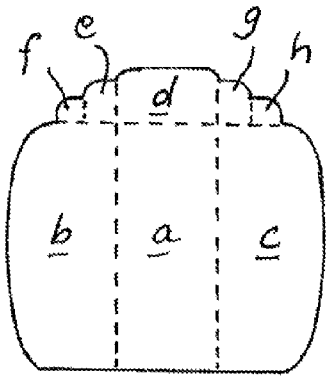
FIG. 4*b* shows diagrammatically a section through a tunnel or a gallery produced by an older variant of a rig.

FIG. 4*b* shows diagrammatically a section through a tunnel or a gallery produced by a rig not being equipped with the inventive aspect, resulting in a "semi-vaulted" roof having been produced through three bottom (a, b and c) and five top cuts (d, e, f, g, h) without rotated (revolved) cutting head. As can be seen from this figure, the profile is less smooth and not as directly suitable for rock enforcement. Time consumed for producing the FIG. 4*b* profile exceeds essentially time consumed for producing the FIG. 4*a* profile since more cuts have to be performed.

Figure 5:
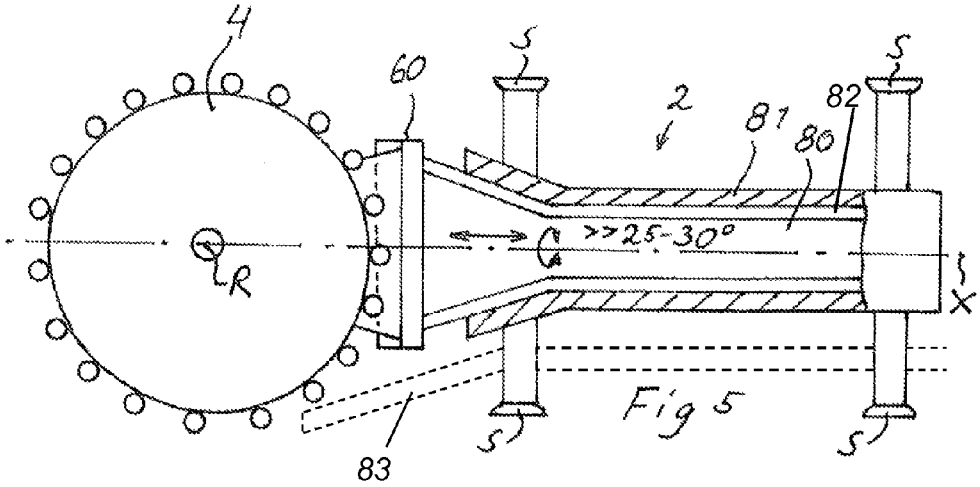
FIG. 5 shows a part section of a rig similar to the one in FIGS. 3*a* and *b*.

FIG. 5 shows a part section of a rig similar to the one in FIGS. 3*a* and *b*. Rotation can be accomplished in various ways. One example is to have an end part of an inner tubular-shaped element 80 being longitudinally movable inside a base unit housing 81 provided with splines 82 at its rear portion for engagement with a rotator. Rotation can be between 0° and 90° but at least 25°-30° and angles well over 25°-30° seen from a neutral position, where the general axis of rotation R is essentially horizontal. A transporter 83 configured to transport away material being loosened during cutting.

Figure 6A:
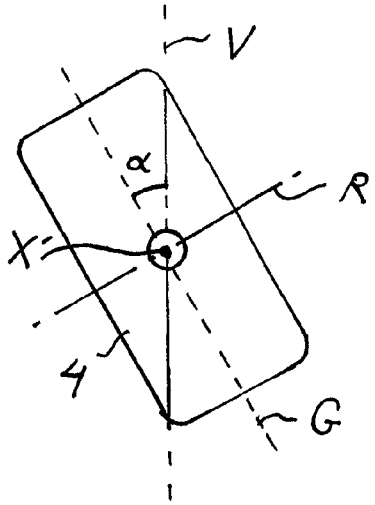
FIG. 6*a* shows in a diagrammatical front view a cutting head being rotated in a skewed angle.

FIG. 6*a* shows a diagrammatical view of a cutting head 4 being rotated such that its angle $\alpha$ of operation between a general plane G of the cutting head (essentially a symmetry plane of the cutting head), being perpendicular to the general axis of rotation R, in respect of a vertical line V is a skewed angle $\alpha$. As is indicated above, in normal use of the invention, the cutting head is swung so as be directed straight forward relative to the longitudinal direction of the rig, which is also in parallel to the pressing direction along the longitudinal axis X of the base unit (see e.g. FIGS. 3*a* and 5). X' in FIG. 6*a* is the local axis shown in FIG. 1*c*. As has been described above, for normal operation of the invention with the skewed angle of the cutting head X and X' coincide (or are at least parallel). The vertical line V is then normally included in a vertical plane roughly being a vertical symmetry plane of the base unit and the rig. FIG. 6*a* also clarifies that the angle $\alpha$ of operation of the cutting head is an angle seen in a vertical plane which includes the general axis of rotation R.

Figure 6B:
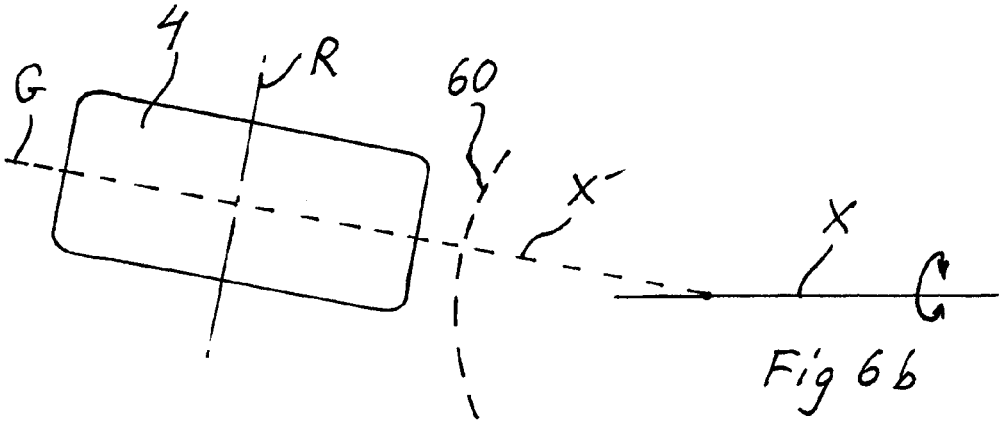
FIG. 6*b* shows in a diagrammatical view from above a cutting head in a swung-out position.

FIG. 6*b* shows in a diagrammatical view from above the cutting head in a somewhat swung-out position. The angle $\alpha$ is here $\alpha$=0. The support unit 60 is indicated with an interrupted line. Axes X and X' cross at a centre of the swing movement (see also FIG. 1*c*).

An exemplary machine operates in a mode where the cutters follow their own tracks (significant difference to background mobile miners). So instead of swinging the cutting head sideways, when working the cutting head, it must be advanced straight or almost straight forward. Since this is a partial face machine, only a portion of face is excavated at one time. This means that the head has to be retracted out of the rock and then moved sideways or vertical in the air and then applied and pressed forward again to cover the entire drift face. In order to reduce the lost time for this necessary repositioning, the machine is designed to have a long stroke.

Finally, the expected performance is to reach 240 to 360 m average advance per month versus background art machine (for best month: 83 m). More power and more cutters calls for a heavier machine for stability reasons.

Tunnel shape and cutting head width and diameter will define how many of these repeated cuts need to be done to complete the face. If 3.5 cuts are needed to make full width it means that in practice 4 cuts have to be performed.

The machine will in normal operation cut the lower cuts at full depth and width. Then the whole machine will be lifted (still horizontal, not tilted) and three (or five) top cuts will be done, each with much less cut volume than the bottom three. Actually two of them are more "polishing" type cuts to generate the desired arch. See examples of profiles in FIGS. 4*a* and *b*.

The exemplary cutting head has a diameter of 4.5 m and a cutting width of 1.8 m. Having a wide head gives the opportunity to mount all needed motors and gearboxes being included in the means for the rotation of the cutting head inside the cutting head and to avoid any quite complex angled drive line.

At the same time, power has now been increased from the old machines (300/500 kW) to 1260 kW. The drive system is based upon VSD (variable speed drive) technique and the speed can be altered from 0-15 rpm in both directions.

The cutting head is mounted in a fork-like carrying unit. This unit can be moved along the curved front plate +/−15 degrees as being part of the swinging arrangement. This movement is normally done under no load and then the fork is locked in position, for the left, right, or center cut. The main body with internal torque tube can, within the gripper frames constituting stabilisers, be lifted horizontally 1.5 meter for the upper cuts. The advance for each cut is a stroke of 1.75 meter achieved by cylinders inside a square tube forcing the bent front plate forward. In the side cuts, the cutting head will thus advance with a small skewed angle, but always in line with the tunnel. "Skewed angle" here means that a plane through the cutting head at right angle to the general axis of rotation R forms a certain angle with a vertical line.

After all the 6 or 8 cuts are completed, the whole machine with trailing back-up system will move forward for next set of strokes. The machine is modular and as such can use spacers beneath the grippers to handle larger tunnels. Also, the front plate, being included in the support unit 60, can be adopted in size for different maxi or mini tunnel widths.

In any case, this machine can not cut a lower profile then 4.5 meter since that's the diameter of the cutting head. However, both larger and smaller machines can be designed using similar components. A cutting head revolving unit can tilt the head sideways +/−30 degrees through rotation of the swinging arrangement in respect of the base unit.

The machine is crawler based, with individually steerable crawlers making it possible to negotiate narrow curves both when boring and when backing out for repositioning to a new face. Muck is collected in front of machine and transported to rear with plural conveyors. The muck can then be delivered to mine trucks or possibly into extendable conveyor systems. The back-up hosts a 2500 kVA system for the MMM machine's VSD and hydraulic systems. Further, there arranged shotcrete pumps, compressors, ventilation fans and dust suction fans. Material transportation of rock bolts, wire mesh, spares, and cutters is provided all the way from the rear to final destination.

Estimated average performance of this technology will be between 10 to 16 m/day. As rock cutting rate changes with different rock conditions, the critical path (rate limiting activity) will change in the process. As an example, a typical cycle in 150 MPa rock for a full advance of 1.75 m inclusive of rock support will take 2 hours 45 minutes. This corresponds to 0.64 m/hr instantaneous rate of penetration. When considering factors that delay cutting and ground support activities, such as planned and unplanned downtime, maintenance, services, and trucking delays, a practical advance rate or 12 m/day may be predicted. It is important to note that in weaker rock, the advance rate speed will be increase significantly. Since rock support is installed concurrently with rock excavation, reaching advance rates of around 16 m/day will, however, be possible with time required for rock support being the process limiting task (critical path).

The invention claimed is:

1. A method for driving tunnels or galleries with a driving rig having a movable base unit which over a support unit supports a carrying unit which in turn carries a cutting head having outwardly directed cutting elements, the method comprising:

swinging the carrying unit into a first chosen mutual position with respect to the support unit;

rotating the support unit into a second chosen mutual position with respect to the base unit around an axis of rotation that is a longitudinal axis of the base unit, thereby positioning the cutting head at an angle of operation;

rotating the cutting head around a general axis of rotation;

applying the cutting head against a rock surface to be worked, while maintaining the cutting head in the angle of operation;

retracting the cutting head from the rock surface;

performing tunnel side cuts essentially in parallel with said longitudinal axis, with the cutting head advancing, the cutting head being positioned in a selected angle of operation while retracted from the rock surface between performing each tunnel side cut; and transporting cut loose material away from the rock surface wherein the angle of operation of the cutting head is changed only while the cutting head is retracted from the rock surface.

2. The method according to claim 1, wherein the side cuts are performed with the rig in an uplifted state.

3. The method according to claim 1, wherein the cutting head is controlled so as to form an angle with respect to a vertical longitudinal symmetry plane of the rig.

4. The method according to claim 1, wherein the cutting elements, which are formed as at least peripherally disc shaped cutting rolls, are brought to roll against the rock surface during pressing against the rock and rotation of the cutting head, and wherein the rock cutting elements during rolling are brought to cut grooves arranged laterally side-by-side in the rock surface at a distance from each other.

5. The method according to claim 4, wherein at least two cutting rolls form one groove.

6. The method according to claim 1, wherein the cutting head is pressed against the rock by being displaced linearly in a driving direction against rock to be worked in a drifting phase during cutting.

7. The method according to claim 1, wherein after completing a cut, the cutting head is drawn away from the rock, displaced to a position with new rock to be worked and repeatedly is brought linearly against the rock for a new driving phase.

8. The method according to claim 1, wherein the rotating cutting head is pressed in a direction which forms an angle between about 70° and 90° with respect to the general axis of rotation against the rock surface to be worked.

9. The method according to claim 1, wherein rotation of the support unit with respect to the base unit is carried out at an angle between 0° and 90° from a neutral position where the general axis of rotation is essentially horizontal.

10. The method according to claim 9, wherein an arch-profiled roof of a tunnel or a gallery is shaped by applying and driving the cutting head with the support unit rotated into different angles with respect to the base unit for each one of a number of cuts.

11. The method according to claim 10, wherein one uppermost, center cut is made with the support unit not rotated, and wherein two cuts at respective upper sides of the arch profiled roof are made with the support unit respectively rotated so as to obtain said angle of the cutting head.

12. The method according to claim 10, wherein a tunnel or gallery is shaped by driving bottom cuts in driving phases with the support unit not rotated with respect to the base unit and with each one of said bottom cuts with the carrying unit swung into different mutual positions with respect to the support unit, and wherein said arch-profiled roof is produced through elevated driving phases with the rig in said uplifted state.

13. The method according to claim 1, wherein the cutting head is applied against a rock surface to be worked with the support unit controllably rotated at an angle with respect to the base unit of between 0° and 90° from a neutral position where the general axis of rotation is essentially horizontal.

14. The method according to claim 13, wherein the cutting head is applied with the application and driving direction forming an angle of 90° with respect to said general axis of rotation for cutting with the support unit rotated with different angles with respect to the base unit.

15. The method according to claim 1, wherein a face of a profiled roof of a tunnel or gallery is shaped as a section of an envelope surface of the cutting head.

16. The method according to claim 1, wherein the selected angle of operation is between a general plane of the cutting head and a vertical line.

* * * * *